US006582117B2

(12) United States Patent
Rogers et al.

(10) Patent No.: US 6,582,117 B2
(45) Date of Patent: Jun. 24, 2003

(54) MIXING APPARATUS INCLUDING A CONTAINER AND A MIXING DEVICE WITH A RELEASABLY CONNECTED RECIPROCATING HEAD

(76) Inventors: Christopher Roy Rogers, 1 Tricks Terrace, Beaford, Winkleigh, Devon, EX19 8LP (GB); Richard Tipton Smith, Myrtle Cottage, Beaford, Winkleigh, Devon, EX19 8LT (GB)

( * ) Notice: Subject to any disclaimer, the term of this patent is extended or adjusted under 35 U.S.C. 154(b) by 0 days.

(21) Appl. No.: 10/168,258

(22) PCT Filed: Jan. 3, 2001

(86) PCT No.: PCT/GB01/00004

§ 371 (c)(1),
(2), (4) Date: Jun. 19, 2002

(87) PCT Pub. No.: WO01/51190

PCT Pub. Date: Jul. 19, 2001

(65) Prior Publication Data

US 2002/0191489 A1 Dec. 19, 2002

(30) Foreign Application Priority Data

Jan. 8, 2000 (GB) ..... 0000296
Feb. 22, 2000 (GB) ..... 0003992

(51) Int. Cl.[7] ..... B01F 11/00
(52) U.S. Cl. ..... 366/332; 366/605
(58) Field of Search ..... 366/255–260, 366/332, 333, 605

(56) References Cited

U.S. PATENT DOCUMENTS 86,094 A * 1/1869 Morter et al.
188,391 A * 3/1877 Marquis
256,329 A * 4/1882 Keeran
338,280 A * 3/1886 Macy
351,655 A * 10/1886 Savage
374,991 A * 12/1887 Nelson
833,656 A * 10/1906 Wynne
945,639 A * 1/1910 Taylor et al.
989,776 A * 4/1911 Gilda
993,130 A * 5/1911 Walters
1,116,585 A * 11/1914 Hachenberger
1,174,828 A * 3/1916 Copeland
1,292,643 A * 1/1919 Pyle
1,776,405 A * 9/1930 Wilsey
2,207,335 A * 7/1940 Thomas et al.
2,486,126 A * 10/1949 Dahnke
4,067,551 A * 1/1978 Reilly
4,195,981 A * 4/1980 Penberthy
5,284,389 A * 2/1994 Lumsden
5,533,802 A 7/1996 Garganese
5,695,282 A * 12/1997 Hess
5,813,760 A * 9/1998 Strong
6,257,755 B1 * 7/2001 Sevelle

FOREIGN PATENT DOCUMENTS

DE 92105629 4/1993

* cited by examiner

*Primary Examiner*—Charles E. Cooley
(74) *Attorney, Agent, or Firm*—Ira S. Dorman

(57) ABSTRACT

Mixing apparatus includes a container for liquid and semi-liquid materials such as paint, and a mixing device in the container, the device having a planar mixing head disposed substantially parallel to the bottom wall of the container and a limb which extends substantially perpendicularly from a peripheral edge region of the mixing head adjacent to the container side wall. A coupling, located in the container, provides releasable connection to an external handle by which the mixing device is reciprocated vertically to agitate and mix the contents of the container. The mixing head may be of triangular, square, substantially circular, with opposed flanges, Y-shaped, or cruciform configuration, and the handle may have a flattened end for use in removing a lid from the container.

8 Claims, 2 Drawing Sheets

MIXING APPARATUS INCLUDING A CONTAINER AND A MIXING DEVICE WITH A RELEASABLY CONNECTED RECIPROCATING HEAD

TECHNICAL FIELD OF THE INVENTION

This invention relates to the mixing of liquid and semi-liquid materials (hereinafter referred to collectively as "liquids").

BACKGROUND

Many liquids such as paints and varnishes require mixing prior to use, and ideally, many require periodic mixing throughout the period of use to prevent separation of the contents or to ensure that the surface layer does not become thick through evaporation. The most common method of mixing liquids in small containers such as paint tins is to stir them with a stick, but this is a very inefficient method of mixing and also presents a problem of disposal when the stick remains coated with the liquid.

When mixing liquids on a larger scale a common form of mixing device is a motorized impeller, but this is not very efficient for mixing viscous materials, and impellers are not easy to clean. Furthermore, the impeller and its associated drive system can impede access to the interior of the container, e.g. for inspection and cleaning purposes.

The present invention seeks to provide a new and inventive form of mixing apparatus.

SUMMARY OF THE INVENTION

The present invention proposes mixing apparatus which includes:

- a liquid container having a bottom wall and a side wall; and
- a mixing device having a generally planar mixing head disposed substantially parallel to said bottom wall, and a limb which extends substantially perpendicular from a peripheral edge region of the head adjacent to the side wall of the container for moving the mixing head up and down in said liquid.

Since the mixing head is normally disposed adjacent to the bottom wall of the container and the limb is disposed adjacent to the side wall the mixing device does not significantly impede access to the contents of the container. Thus, if the liquid is paint for example, after the initial mixing the device can remain in the container while the paint is removed, allowing the paint to be periodically agitated.

A preferred aspect of the invention is that the limb is provided with reciprocating means for moving the mixing head, the reciprocating means being located above the container and coupled to the limb by releasable connection means. In the case of a small container such as a paint tin the releasable connection is preferably located within the container so that the mixing device can remain within the container allowing the container to be resealed if desired. The mixing device can be manufactured relatively cheaply so that it can be disposed of with the container. In a simple form the reciprocating means may comprise a grasping handle for attachment to the limb externally of the container so that the handle may be grasped clear of the liquid without risk of major contamination with the liquid. The handle can be reused a number of times with the same or another mixing device.

The mixing head could be of various shapes and configurations depending on the nature of the liquid being mixed.

The mixing head preferably contains at least one aperture and preferably covers between 30 and 60 percent of the area of the bottom wall of the container. As the mixing head approaches the bottom of the container a high laminar flow is created at the bottom of the container which has the effect of carrying any settled materials into the body of the liquid. When the mixing head is static a proportion of any settled materials will lie on top of the mixing head and be lifted with it, assisting the re-mixing.

BRIEF DESCRIPTION OF THE DRAWINGS

The following description and the accompanying drawings referred to therein are included byway of non-limiting example in order to illustrate how the invention may be put into practice. In the drawings.

DETAILED DESCRIPTION OF THE DRAWINGS

Figure 1:
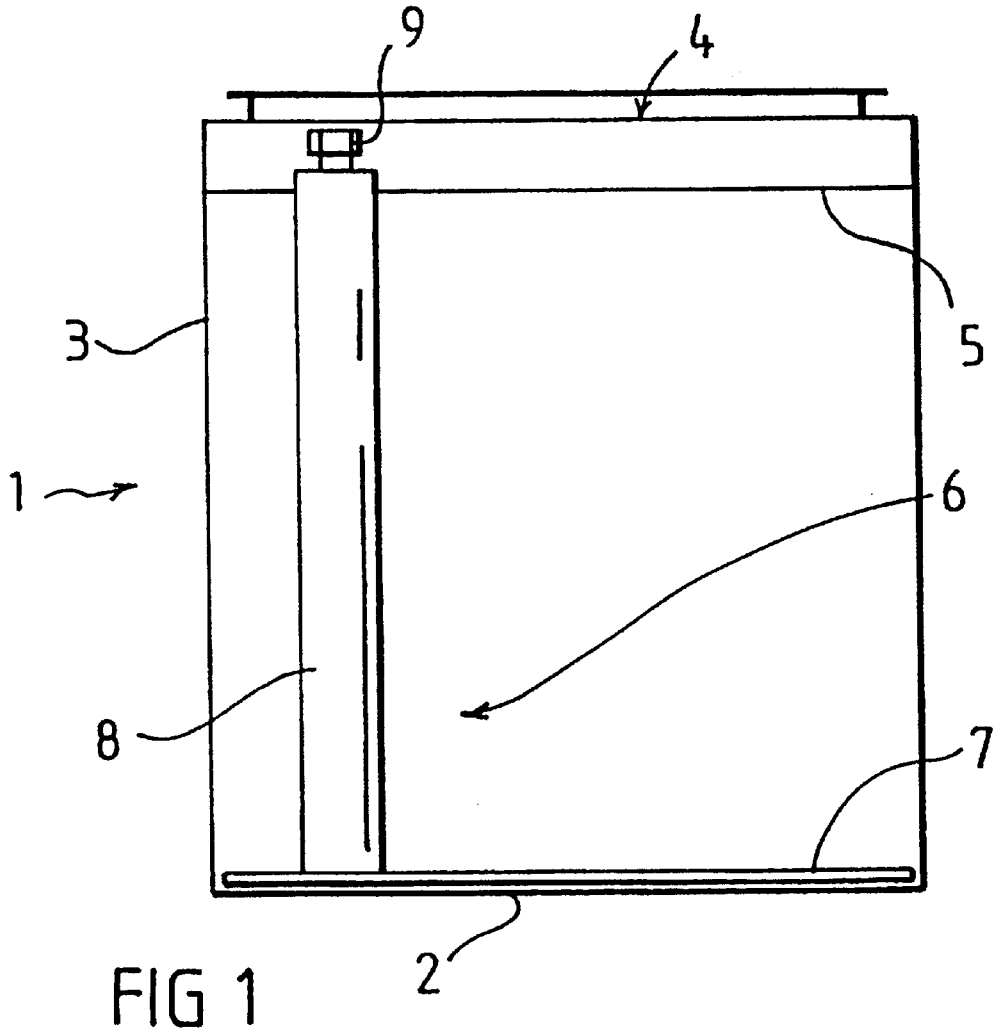
FIG. 1 is a vertical section through mixing apparatus in accordance with the invention.

Referring firstly to FIG. 1, a paint container or can 1 of metal or plastics has a circular bottom wall 2, a cylindrical side wall 3 and a press-fit lid 4. The container is substantially filled with liquid paint such that there is a small air gap between the surface 5 and the lid 4. A mixing device 6 is supplied inside the can. The device can be formed of metal or plastics and includes a mixing head 7 and an upstanding limb 8. The head 7 is substantially planar so that it rests on the bottom wall 2. The limb 8 may take the form of a round rod which projects above the level of the liquid to terminate in a screw-threaded coupling 9 of reduced diameter. The rod is secured at the peripheral edge of the mixing head 8 to stand adjacent to the side wall of the can but with the coupling 9 accessible within the can opening.

Figure 2:
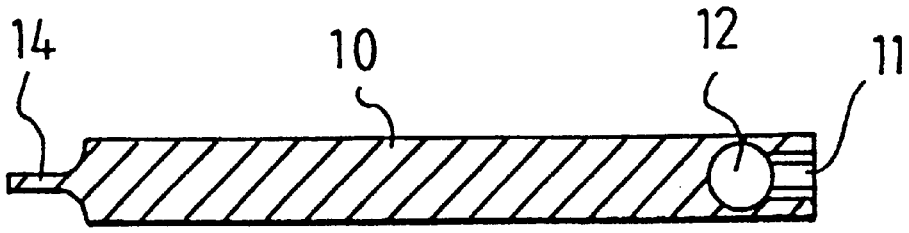
FIG. 2 is a longitudinal section through a handle for use with the mixing apparatus.

Referring to FIG. 2, a separate reusable handle 10 is provided. The handle is of elongate shape and has an internally screw-threaded socket 11 at one end for releasable connection with the coupling 9. The blind end of the socket may be provided with an intercepting cross-bore 12 for the escape of trapped air or liquid. Thus, when the lid is removed from the container the handle will project co-axially with the limb 8 allowing the mixing device to be gripped in the hand and moved up-and-down through the liquid. The turbulence thereby created as the paint flows through and/or around the mixing head 7 creates an effective mixing action which ensures thorough mixing of the paint in a relatively short period of time.

The upper end of the handle may be formed into a flattened blade 14 which can be utilized for levering the lid from the paint can. The handle could be a plastic molding, shaped to be aesthetically pleasing and comfortable to hold. Other releasable means of attachment could be used, e.g. a releasable spring-loaded clip or an insert-and-twist bayonet type fitting.

The flat mixing head 7 should be shaped to locate within the can 1 so that the limb 8 is located within the top opening where it will be readily accessible for the handle to be attached. When the can lid is fitted the mixing device is located against axial or lateral movement within the can. If the mixing device is put into a finished can it must be capable of being passed through the can opening, e.g. by tilting or flexing. On the other hand it may be practicable to incorporate the mixing device into the can during its manufacture.

If the mixing devices are formed of a material which is denser than the liquid in the can then the mixing devices may locate loosely in the can as the mixing device will naturally sink. On the other hand, if they are made of a material less dense than the liquid the can so that they will naturally float it will be desirable to prevent this by shaping the mixing head to contact the can and generate sufficient frictional resistance that they will stay where they are put. In general metal mixing devices will naturally sink and may be a loose fit whereas plastic mixing devices will need to contact the can wall.

The mixing head 7 will be tailored to suit the material to be mixed. As a general rule thick materials require a mixing head of smaller surface area and thin materials require a head of larger surface area.

If the mixing devices are of plastic then the limb 8 can be moulded integral with the mixing head. If they are to be supplied separately from the can it would be advantageous if the mixing devices stack on top of each other offering easier handling and storage. This could be achieved by making the limbs tapered and hollow. To prevent air being trapped when the cans are filled or a pocket of material being trapped during mixing the limbs could have a slot up one side. The tapered shape could be a simple cone but a three or four sided pyramid shape would not only stack but locate the mixing devices which would be advantageous when removing them from the stack for placing in the can.

The use of such mixing devices is not restricted to cylindrical cans. Square or rectangular containers could also be used. Nor are the mixing devices restricted to containers with a large opening. If the mixing device is incorporated into the container during its assembly and the limb 8 is suitably positioned it could be accessed through a restricted screw top opening allowing the materials to be mixed prior to pouring out for use.

In use it is envisaged that the mixing device will be placed in the can prior to being filled with material and the lid fitted. The end user will open the can using the handle, exposing the top of the limb above the material. The handle is then attached to the limb and the material mixed by moving the mixing device up and down. The handle may remain attached during use as its position at the edge of the can opening will not impede access to the material with a brush making frequent mixing during use very easy. The handle can be detached and the lid refitted at any time when the user has finished.

The very bottom of the handle might possibly come into contact with the material and this may be cleaned off at the same time and with the same solvent as used for cleaning the brush, or it may be left to dry.

The mixing device can be manufactured relatively cheaply as a disposable item which is simply discarded with the container and is never cleaned.

Figure 3:
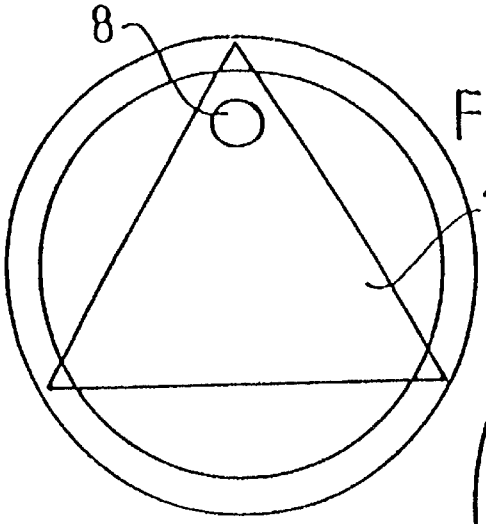
FIGS. 3 to 7 are plan views of the mixing apparatus showing various modifications thereof.
Figure 4:
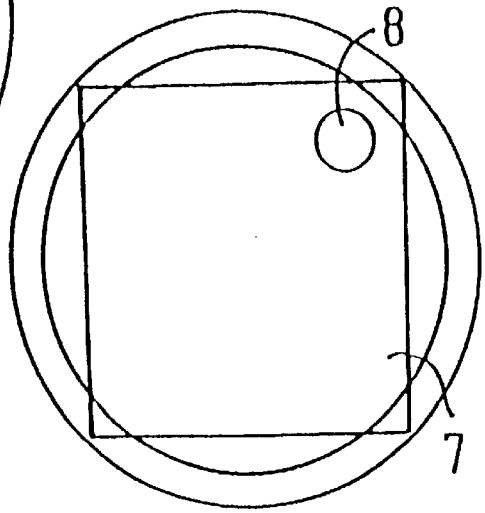
Figure 5:
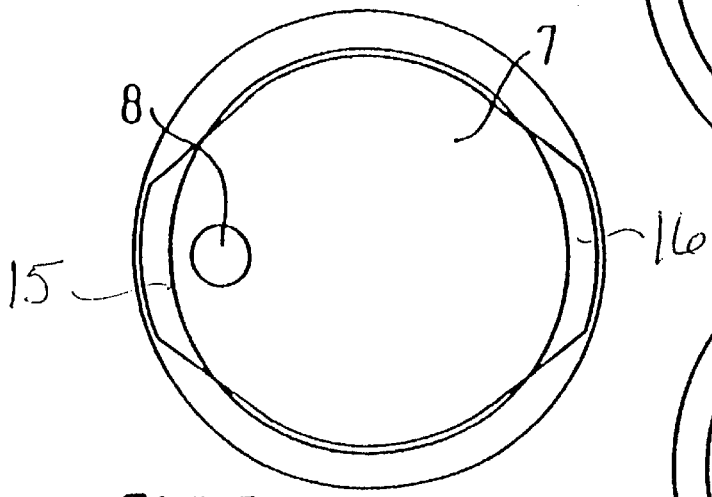
Figure 6:
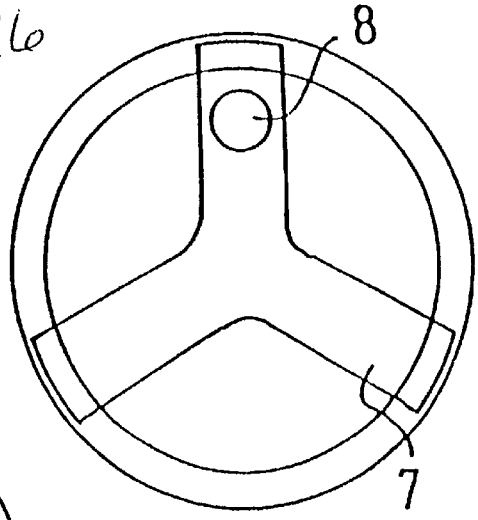
Figure 7:
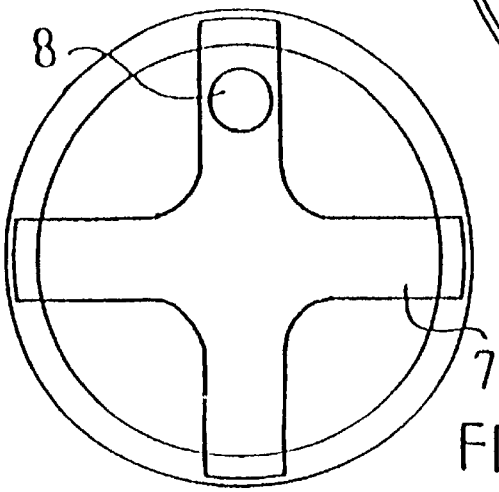

The outline of the head 7 may be of various planar shapes, e.g., triangular as in FIG. 3, square as in FIG. 4, substantially circular with opposed flanges 15 and 16, as in FIG. 5, Y-shaped as in FIG. 6, or cruciform as in FIG. 7, all of which can be manipulated into a can after manufacture.

The area of the head may be reduced by cutting one or more shaped or circular holes from the centre region if appropriate.

The invention thus provides a simple mixing system offering convenience to the user, effective mixing, with a mixing head tailored to the materials, allowing easy access with a brush, entailing little or no cleaning, and which is available all the time that the materials are in use. Thorough mixing can generally be achieved in 30 to 40 strokes of the mixing device.

The invention is particularly useful for mixing colored paints. The paint cans can contain a base color while measured quantities of colouring materials are supplied separately, e.g. in small sachets or disposable syringes. Thus, stores are no longer required to carry large stocks of ready-mixed paints which take up considerably more storage space.

In the case of a container having a screw cap it would be possible to attach the arm of the mixing device to the cap so that the cap can be used as a handle to move the mixing deice up and down.

Although the above example concerns a small container, i.e. a paint can, it is possible to use a scaled-up version of the mixer for bulk mixing of liquids. The handle would be replaced by a reciprocating motor connected to the limb by a releasable coupling to allow the motor to be used with different mixing devices and the container to be sealed when required. There is thus easy access to the interior of the container, e.g. for inspection purposes, and the mixer is easily cleaned, for example by lowering a spray ball into the container to wash above and below the mixing head.

It will be appreciated that the features disclosed herein may be present in any feasible combination. Whilst the above description lays emphasis on those areas which, in combination, are believed to be new, protection is claimed for any inventive combination of the features disclosed herein.

What is claimed is:

1. Mixing apparatus which includes:

a liquid container (1) having a bottom wall (2) and a side wall (3) with a top opening for receiving a container lid (4); and a mixing device (6) having a generally planar mixing head (7) disposed substantially parallel to said bottom wall and being located by said side wall to prevent substantial lateral movement of said mixing head, and a limb (8) which extends substantially perpendicularly from the mixing head with reciprocating means (10) located above the container for moving the mixing head up and down in the container; in which the limb is secured to a peripheral edge region of the mixing head adjacent to the side wall of the container;

the reciprocating means (10) is coupled to the limb (8) by releasable connection means (9,11); and when said mixing head contacts said bottom wall said releasable connection means is located within the container immediately below said top opening.

2. Mixing apparatus according to claim 1, in which the reciprocating means incorporates a grasping handle (10) for manually moving the mixing head up and down.

3. Mixing apparatus according to claim 2, in which the grasping handle (10) includes a blade (14) at the upper end of the gripping handle remote from said releasable connection means.

4. Mixing apparatus according to claim 1, in which the profile of the mixing head (7) is substantially circular with opposed flanges (FIG. 5).

5. Mixing apparatus according to claim 1, in which the mixing head (7) covers between 30 and 60 percent of the area of the bottom wall of the container.

6. Mixing apparatus according to claim 1, in which the mixing head (7) is of substantially triangular profile (FIG. 3).

7. Mixing apparatus according to claim 1, in which the mixing head (7) is of substantially square profile (FIG. 4).

8. Mixing apparatus according to claim 1, in which the mixing head (7) is of substantially Y-shaped or cruciform profile (FIGS. 6 and 7).

* * * * *